US006413107B1

(12) United States Patent
Neuhorst et al.

(10) Patent No.: US 6,413,107 B1
(45) Date of Patent: Jul. 2, 2002

(54) LAMP

(75) Inventors: Paul Heinrich Neuhorst, Pfaffenweiler; Clemens Meyer, Bollschweil, both of (DE)

(73) Assignee: Spectral Gesellschaft für Lichttechnik mit beschränkter Haftung, Freiburg (DE)

( * ) Notice: Subject to any disclaimer, the term of this patent is extended or adjusted under 35 U.S.C. 154(b) by 0 days.

(21) Appl. No.: 09/549,763

(22) Filed: Apr. 14, 2000

(30) Foreign Application Priority Data

Apr. 15, 1999 (DE) ..... 299 06 741 U

(51) Int. Cl.[7] ..... H01R 33/02
(52) U.S. Cl. ..... 439/226; 439/232
(58) Field of Search ..... 439/232, 236, 439/233, 234, 226, 537, 180, 346, 181

(56) References Cited

U.S. PATENT DOCUMENTS

| | | | | |
|---|---|---|---|---|
| 263,103 A | * | 8/1882 | Bergmann | 439/537 |
| 4,799,134 A | * | 1/1989 | Pinch et al. | 362/117 |
| 5,111,370 A | * | 5/1992 | Clark | 362/147 |
| 5,702,264 A | * | 12/1997 | Endo et al. | 439/346 |

FOREIGN PATENT DOCUMENTS

| | | |
|---|---|---|
| DE | 1 860 681 | 10/1962 |
| DE | 79 14 279 | 11/1979 |
| DE | 81 13 313 | 3/1986 |
| DE | 4028461 | 3/1992 |
| DE | 43 16 271 | 11/1994 |
| DE | 29700644 | 5/1997 |
| EP | 0159145 | 10/1985 |
| EP | 0677699 | 10/1995 |
| FR | 2750477 | 1/1998 |
| GB | 2194625 | 3/1998 |

* cited by examiner

*Primary Examiner*—Gary Paumen
*Assistant Examiner*—Alexander Gilman
(74) *Attorney, Agent, or Firm*—Gudrun E. Huckett

(57) ABSTRACT

A lamp has a lamp body having a first socket and a second socket configured to receive matching bases of a tubular fluorescent light. At least the first socket has a housing that is of such a design that the housing, with a base of the fluorescent tube received and electrically contacted in the first socket, is detachably connected to the lamp body. The detachable connection is a snap connection having a bore and a matching pin that can be secured in the bore by a snap element engaging a locking recess on the pin.

7 Claims, 4 Drawing Sheets

LAMP

BACKGROUND OF THE INVENTION

1. Field of the Invention

The invention relates to a lamp having two sockets for receiving matching bases of a tubular fluorescent light.

2. Description of the Related Art

In order to mechanically secure the tubular fluorescent light of a lamp within the lamp body while supplying the fluorescent light with the needed electrical voltage, the ends of the lamp body have a respective socket for the two bases of the fluorescent light. There are two types of sockets for fluorescent lights. Firstly, a rotary socket is known but the securing action for the fluorescent light in such rotary sockets is disadvantageously not optimal. Secondly, there are plug-in sockets which have the advantage that they strongly clamp the base pins of the fluorescent light upon insertion of the light into the socket and thus prevent the fluorescent light from sliding out of the socket.

SUMMARY OF THE INVENTION

It is an object of the present invention to provide a lamp of a modular design and configuration.

In accordance with the present invention, this is achieved in that at least one of the two sockets is arranged in a housing that is separate from the actual lamp body and can be detachably arranged at the lamp body together with a tubular fluorescent light contacted therein.

This provides a modular plug-in system for lamps that use fluorescent lights. Of the above mentioned two possible conventional sockets, i.e., a rotary socket and a plug-in socket, the lamp according to the invention employs the latter. The basic idea of the inventive lamp is that first the two housings with the respective sockets arranged therein are placed onto the two bases of the fluorescent light, and the housings, together with the attached fluorescent light, are fastened subsequently to the actual lamp body, wherein, according to the invention, the housings are to be designed such that they are detachable in a technically simple manner in order to thus be able to exchange a defective fluorescent light without problems. It is important in this context that the housing with its socket is embodied as a separate part that is detachable from the actual lamp body. The housing for the sockets can be epipedal, especially a cube. Any other form or shape of the housing is, of course, also imaginable and usable. Since the bases of the fluorescent lights are in the form of plug-in bases, they are fixedly connected within the housing, and since, moreover, the housings are fixedly arranged at the actual lamp body, there is no risk that the fluorescent light could accidentally become detached from the plug-in sockets. This is true especially when the housings are directly connected to the actual lamp body.

According to a further embodiment, the base of the fluorescent light is completely received in the respective housing. This has the advantage that the two ends of the fluorescent light are secured extremely safely within the lamp body. Moreover, the bases of the fluorescent light are covered visually by the housing and can thus not be seen by an onlooker, which improves the visual appearance of the lamp. This can be technically solved in a simple manner in that the housing has a single opening for receiving the bases of the fluorescent lights while otherwise the housing is completely closed. When the housing is epipedal, especially a cube, that side of the housing which faces the base of the fluorescent light is removed.

In another preferred technical embodiment the housing is arranged by means of a releasable snap connection to the lamp body. Accordingly, a plug-in system is disclosed which functions as follows. First, the two housings are secured onto the two bases at the ends of the fluorescent light. Subsequently, the housings with their snap or locking elements are snapped into place in the matching snap or locking elements provided at the lamp body, and this completes mounting of the lamp. By releasing the snap elements, the housings and thus the fluorescent light can again be removed.

In a concrete technical realization of this releasable snap connection, the lamp body and the housing have a bore and a matching pin insertable into the bore wherein the pin can be secured in the bore. Preferably, pins are provided on the housings which, after placement of the two housings onto the bases at the ends of the fluorescent light, are inserted into bores of the lamp body so that they are correctly positioned. It is then only required to secure the pins in the bores of the lamp body. This can be achieved by a special locking arrangement. The pins and the bores can have a round cross-section. However, they can also be embodied with a cross-section that is not round, especially, an angular cross-section.

A further embodiment concerns so-called suspended lamps wherein the pin is embodied at the upper end of a rod which projects perpendicularly upwardly from the housing. In such a design, the fluorescent light is arranged at a spacing below the actual lamp body. In this case, the suspending rods at the same time also provide the attachment of the housings at the lamp body. When the rods have a tendency to swing, an additional securing device for the bases of the fluorescent lights can be provided within the housing.

According to a further embodiment, the electrical supply cable is "invisible" in that it is guided through the rod and/or the pin. A further advantage of this arrangement is that the housings are still secured to the lamp body by the electric cable even if the housings become detached from the lamp body.

In a further embodiment, the lamp body and the pin are provided with a locking arrangement comprised of a locking recess and a corresponding spring-loaded snap element. This has the advantage that a technically simple fixation of the pins in the correlated bores is possible. The spring-loaded snap elements engage the corresponding locking recess upon insertion of the pin into the bore so that the housing is securely held at the lamp body. The locking recess can be, for example, an annular groove provided on the pin. The spring-loaded snap element can be a pin.

The configuration of the releasable snap connection is preferably such that upon pulling the pin out of the bore, the snap element is automatically moved out of the locking recess by respectively provided guide surfaces. This has the advantage that the fluorescent light can be removed without requiring tools. It is only necessary to pull the two housings with the sockets in a downward direction. With correspondingly designed guide surfaces, the snap element is forced to the rear counter to the force of the spring loading the snap element. The guide surfaces can be convex or concave spherical surfaces.

The lamp body and the housing can have a releasable snap connection comprised of a locking pawl and a matching locking recess. This is an alternative to the pin/bore configuration of the releasable snap connection in which the pin is rigid. This alternative comprises thus a locking pawl which in itself is spring-elastic and which upon insertion into the matching recess snaps into a corresponding locking recess.

It is conventional to provide all light-guiding or glare-reducing elements, for example, louvers or diffusers, at the lamp body or at the housing of the base. According to the invention, such light-guiding elements can be fastened directly to the fluorescent light, for example, simply by being suspended therefrom.

DESCRIPTION OF THE PREFERRED EMBODIMENTS

Figure 1:
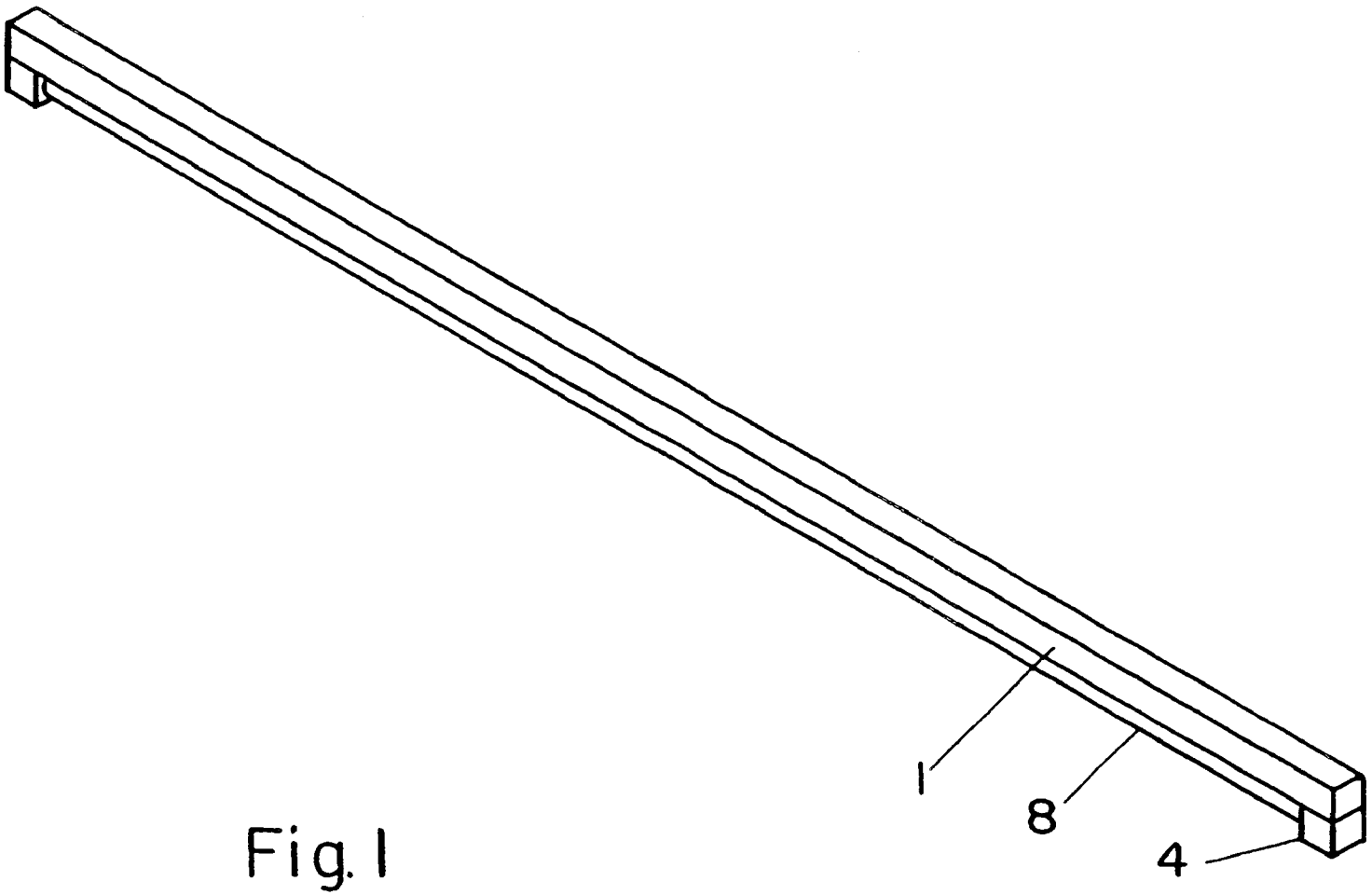
FIG. 1 shows a first embodiment of the lamp according to the present invention in a perspective view.
Figure 3:
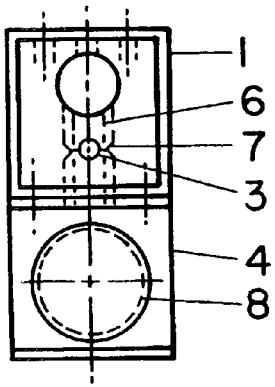
FIG. 3 is a section along the line III—III of FIG. 2.
Figure 4:
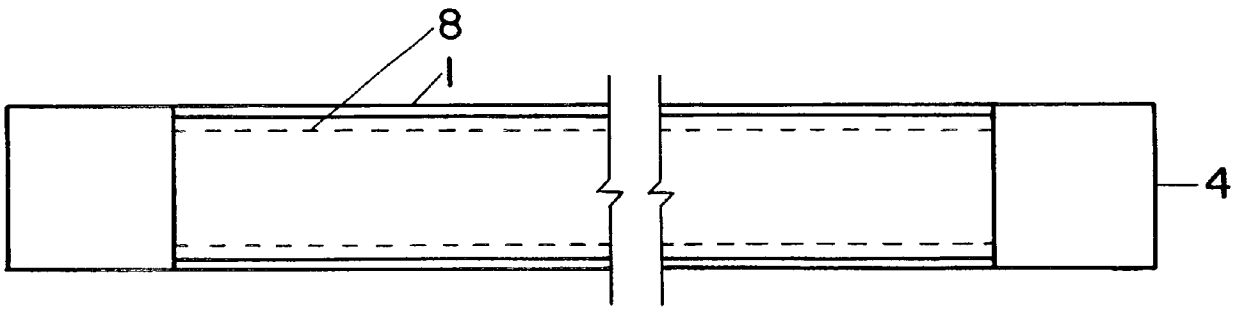
FIG. 4 is a bottom view of the lamp.
Figure 5:
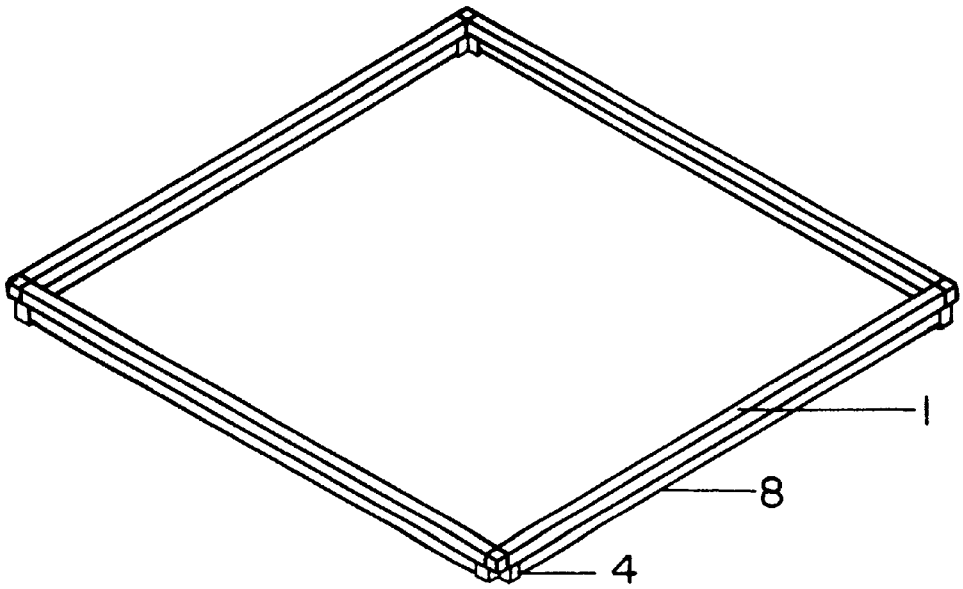
FIG. 5 is a perspective illustration of a second embodiment that is based on the technical principles of the first embodiment.
Figure 6:
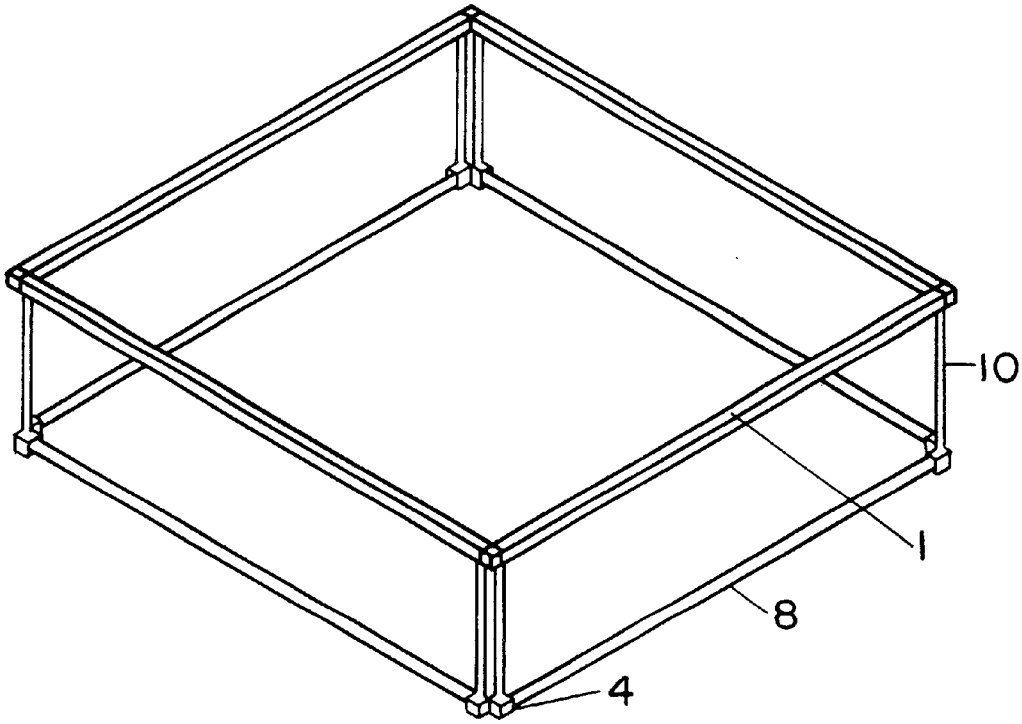
FIG. 6 shows a third embodiment as an alternative to the second embodiment for a lamp of a suspended design.
Figure 8:
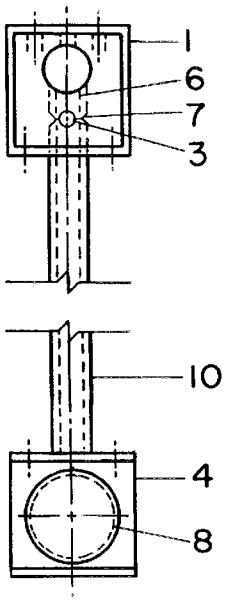
FIG. 8 is a section along the line VIII—VIII of FIG. 7.
Figure 7:
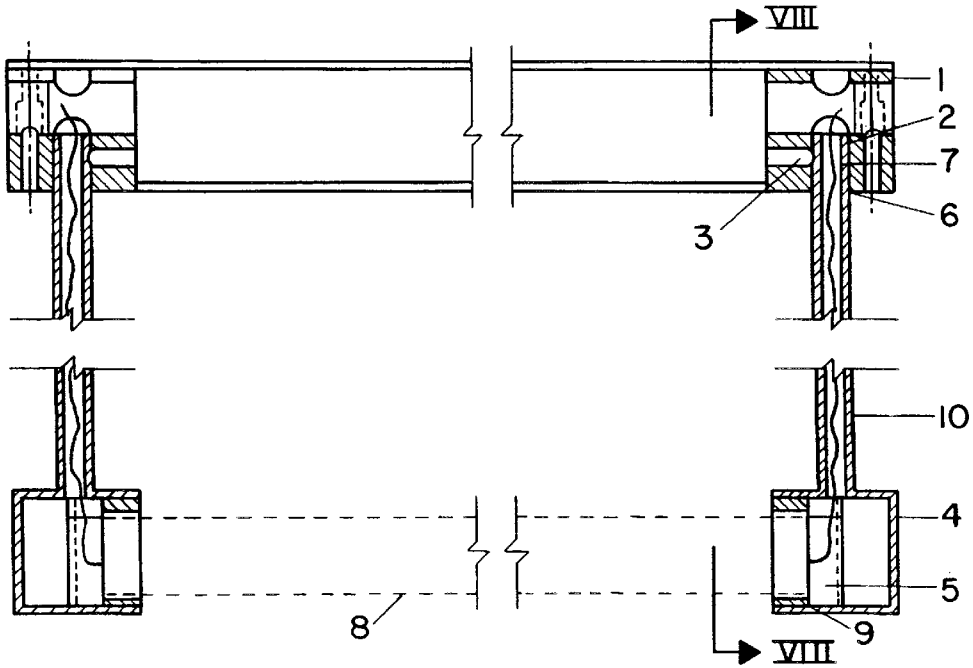
FIG. 7 is a longitudinal section of the lamp of FIG. 6.
Figure 9:
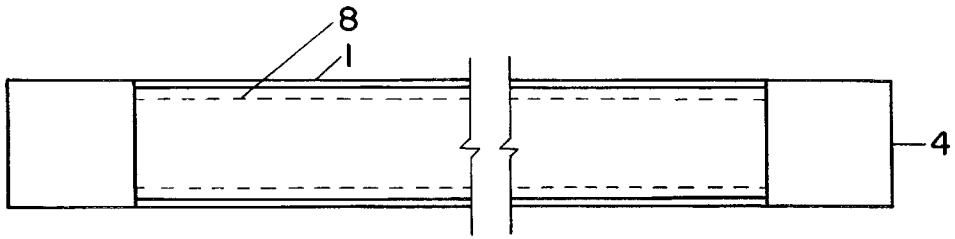
FIG. 9 is a bottom view of the lamp of FIG. 6.

In the FIGS. 1 through 4, a first embodiment, in FIG. 5 a second embodiment, and in the FIGS. 6 through 9 a third embodiment of the lamp according to the present invention are illustrated.

Figure 2:
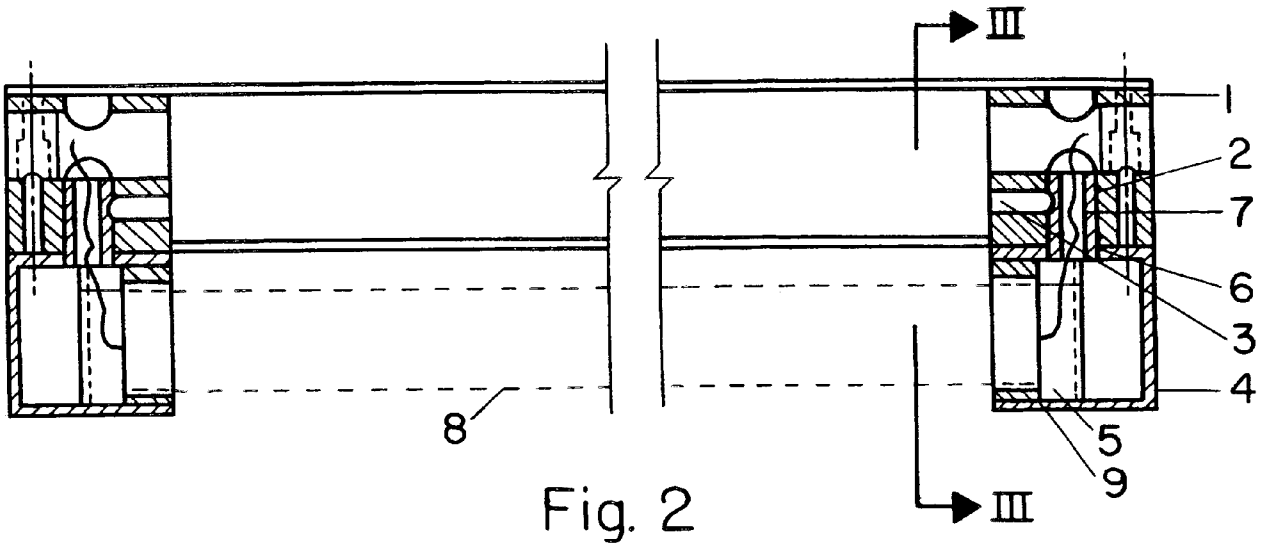
FIG. 2 is a longitudinal section of the lamp of FIG. 1.

The first embodiment of the lamp illustrated in FIGS. 1 through 4 has a lamp body 1 which is directly fastened to the ceiling. As illustrated in FIGS. 2 through 4, the lamp body 1 has at its ends a respective vertical bore 2. Transverse to this bore 2 a spring-loaded snap element 3 is arranged and projects with its leading end into this bore 2. The leading end of the snap element 3 is shaped as a spherical segment.

Moreover, the lamp has two cube-shaped housings 4. One sidewall of each housing 4 is open. In the interior of the housing 4 the socket 5 is respectively arranged. The upper side of the housing 4 is provided with a pin 6 projecting vertically outwardly. It has a locking recess 7 arranged such that it is positioned at the location of the snap elements 3 when inserted. The recess 7 is formed as a circumferential annular groove.

The function of the lamp of FIGS. 1 through 4 is as follows:

A fluorescent light 8 to be mounted within the lamp 1 has at its two ends a respective base 9. A housing 4 with socket 5 is placed onto each one of these two bases 9. In this way, on the one hand, the fluorescent light 8 is secured and, on the other hand, electrical contact with an electrical power supply is provided. This electrical power supply is realized by a cable, not shown, which is guided through the pins 6 into the sockets 5. The thus assembled unit comprised of first housing 4, fluorescent light 8, second housing 4 is then inserted into the respective bores 2 in the lamp body 1 with the pins 6 leading. The snap elements 3 of the lamp body 1 move into the locking recesses 7 of the pins 6 and snap into place. This means that the housings 4 are secured in their position.

In order to be able to replace a fluorescent light 8, it is only necessary to pull the two housings 4 downwardly and subsequently remove the two housings 4 outwardly in opposite directions from the fluorescent light 8 so that the bases 9 are pulled out of the sockets 5. In this state, the two housings 4 are suspended from the electrical supply cables.

The second embodiment of the lamp in FIG. 5 shows a lamp with a square basic structure. This means that four lamp bodies 1 of the first embodiment of FIGS. 1 through 4 are combined to form the square configuration. This configuration can also be directly connected to the ceiling. The basic principle is the same as that of the individual lamp bodies 1 of the first embodiment.

The third embodiment of FIGS. 6 through 9 differs from the second embodiment of FIG. 5 only in that the pins 6 are elongated to form suspending rods 10. This means that the fluorescent light 8 is suspended from the lamp body 1 fastened to the ceiling, as is illustrated especially in FIG. 6. Otherwise, this third embodiment is identical to that of the second embodiment.

Of course, it is also imaginable to employ only a single lamp body 1 as illustrated in the first embodiment of FIGS. 1 through 4, but to extend the pins 6 to form rods 10 so that an individual lamp 1 with fluorescent light 8 can also have a suspended configuration.

While specific embodiments of the invention have been shown and described in detail to illustrate the inventive principles, it will be understood that the invention may be embodied otherwise without departing from such principles.

What is claimed is:

1. A lamp comprising:

a lamp body (1) having opposed ends;

a first separate housing (4) having a first plug-in socket (5) and a second separate housing (4) having a second plug-in socket (5), wherein said first and second separate housings (4) are configured to be detachably connected to said lamp body (1);

wherein said first and second plug-in sockets (5) are configured to receive bases of a tubular fluorescent light (8);

wherein, for assembling said lamp, said first and second separate housings (4) with said first and second plug-in sockets (5) are placed onto the bases of the tubular fluorescent light (8) forming an assembled unit comprised of said first housing (4), the tubular fluorescent light, and said second housing (4);

wherein said assembled unit is subsequently connected via said first and second housings (4) to said lamp body (1);

wherein said lamp body (1) and said first and second separate housings (4) are connected by a releasable snap connection, respectively, and wherein said releasable snap connection comprises a bore (2) arranged in said first and second housings (4) or said lamp body (1) and a matching pin (6) releasable inserted and secured in said bore (2) and arranged on said lamp body (1) or said first and second housings (4);

further comprising electrical supply cables guided within said pins (6); and wherein said first and second housings (4), after having been detached from said lamp body (1), are suspended from said electrical supply cables.

2. The lamp according to claim 1, wherein said first and second housings (4) are configured to completely receive the bases of the fluorescent tube (8).

3. The lamp according to claim 1, further comprising light-guiding elements suspended from the fluorescent tube (8).

4. The lamp according to claim 1, wherein said first and second housings (4) comprise a rod (10) projecting vertically upwardly from said first and second housings (4) and wherein said pin (6) is arranged at an upper end of said rod (10).

5. The lamp according to claim 4, further comprising an electrical supply cable guided within said rod (10) and said pin (6).

6. The lamp according to claim 1, wherein said pin (6) has a locking recess (7) and wherein said releasable snap connection comprises a spring-loaded snap element (3) engaging said locking recess (7) for securing said pin (6) in said bore (2).

7. The lamp according to claim 6, wherein said pin (6) has guide surfaces configured such that said snap element (3) is automatically guided out of said recess (7) when pulling said pin (6) out of said bore (2).

* * * * *